US012612145B2

(12) United States Patent
Murayama et al.

(10) Patent No.: US 12,612,145 B2
(45) Date of Patent: Apr. 28, 2026

(54) MARINE VESSEL MANEUVERING SUPPORT APPARATUS, AND MARINE VESSEL

(71) Applicant: YAMAHA HATSUDOKI KABUSHIKI KAISHA, Iwata (JP)

(72) Inventors: Takuya Murayama, Shizuoka (JP); Masaru Tamaki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 461 days.

(21) Appl. No.: 18/118,839

(22) Filed: Mar. 8, 2023

(65) Prior Publication Data

US 2023/0286635 A1 Sep. 14, 2023

(30) Foreign Application Priority Data

Mar. 10, 2022 (JP) ..... 2022-036903

(51) Int. Cl.
*B63H 25/04* (2006.01)
*B63H 25/42* (2006.01)

(52) U.S. Cl.
CPC ..... *B63H 25/04* (2013.01); *B63H 25/42* (2013.01)

(58) Field of Classification Search
CPC ..... B63H 25/04; B63H 25/42; B63H 20/12; B63H 25/02; B63H 25/50; B63H 2020/003; B63H 2025/026
See application file for complete search history.

(56) References Cited

U.S. PATENT DOCUMENTS 8,924,054 B1 * 12/2014 Arbuckle ..... G05D 1/0206 701/518
9,132,903 B1 * 9/2015 Gable ..... B63J 99/00
2010/0191397 A1 7/2010 Nose et al.

FOREIGN PATENT DOCUMENTS

EP 1775212 A2 * 4/2007 ..... B63H 21/22
JP 2001-334995 A 12/2001
JP 2005-200004 A 7/2005
JP 5351785 B2 11/2013

* cited by examiner

*Primary Examiner* — James J Lee
*Assistant Examiner* — Andrew Sang Kim
(74) *Attorney, Agent, or Firm* — Keating & Bennett, LLP

(57) ABSTRACT

A marine vessel maneuvering support apparatus includes a controller configured or programmed to execute a lateral movement mode, in which a lateral thrust is applied to a hull, by controlling at least two propulsion devices in response to receiving an instruction to laterally move the hull. The controller is configured or programmed to control the propulsion devices so as to generate a thrust to pivot-turn the hull at least at a start of the lateral movement mode.

16 Claims, 15 Drawing Sheets

MARINE VESSEL MANEUVERING SUPPORT APPARATUS, AND MARINE VESSEL

CROSS REFERENCE TO RELATED APPLICATIONS

This application claims the benefit of priority to Japanese Patent Application No. 2022-036903, filed on Mar. 10, 2022. The entire contents of this application are hereby incorporated herein by reference.

BACKGROUND OF THE INVENTION

1. Field of the Invention

The present invention relates to a marine vessel maneuvering support apparatus, and a marine vessel.

2. Description of the Related Art

Conventionally, a lateral movement, which moves a hull of a marine vessel laterally, is performed for undocking or docking of the marine vessel, etc. Japanese Laid-Open Patent Publication (kokai) No. 2005-200004 discloses a technique that controls two propulsion devices in response to instructions to apply a lateral thrust to the hull. However, when the hull starts to move laterally from a stationary state, a large load due to water resistance and an inertia moment of the hull is applied to the hull, and therefore the lateral movement is inefficient. As a result, since the hull starts to move slowly and it takes a long time to reach a desired location such as the shore, sometimes the lateral movement is not smooth.

On the other hand, the publication of Japanese Patent No. 5351785 discloses a technique in which by operating two operation levers, a marine vessel user is able to realize various behaviors including the lateral movement by intuitive operations.

However, in the technique disclosed in the publication of Japanese Patent No. 5351785, in order to realize a smooth lateral movement, it is necessary for the marine vessel user to learn how to operate the two operation levers. There is room for improvement from the viewpoint of realizing the smooth lateral movement at all times, regardless of the degree of mastery of operation skills of the two operation levers.

SUMMARY OF THE INVENTION

Preferred embodiments of the present invention provide marine vessel maneuvering support apparatuses and marine vessels that are each able to realize a smooth lateral movement of a hull.

According to a preferred embodiment of the present invention, a marine vessel maneuvering support apparatus includes a controller configured or programmed to execute a lateral movement mode, in which a lateral thrust is applied to a hull, by controlling at least two propulsion devices in response to receiving an instruction to laterally move the hull. The controller is configured or programmed to control the propulsion devices so as to generate a thrust to pivot-turn the hull at least at a start of the lateral movement mode.

According to another preferred embodiment of the present invention, a marine vessel includes the marine vessel maneuvering support apparatus described above, and the at least two propulsion devices.

According to preferred embodiments of the present invention, at least two propulsion devices are controlled so as to generate the thrust to pivot-turn the hull at least at the start of the lateral movement mode. For example, the hull starts to move faster due to the thrust to pivot-turn the hull, and the hull laterally moves smoothly. As a result, it is possible to realize the smooth lateral movement of the hull.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

Hereinafter, preferred embodiments of the present invention will be described with reference to the drawings.

Figure 1:
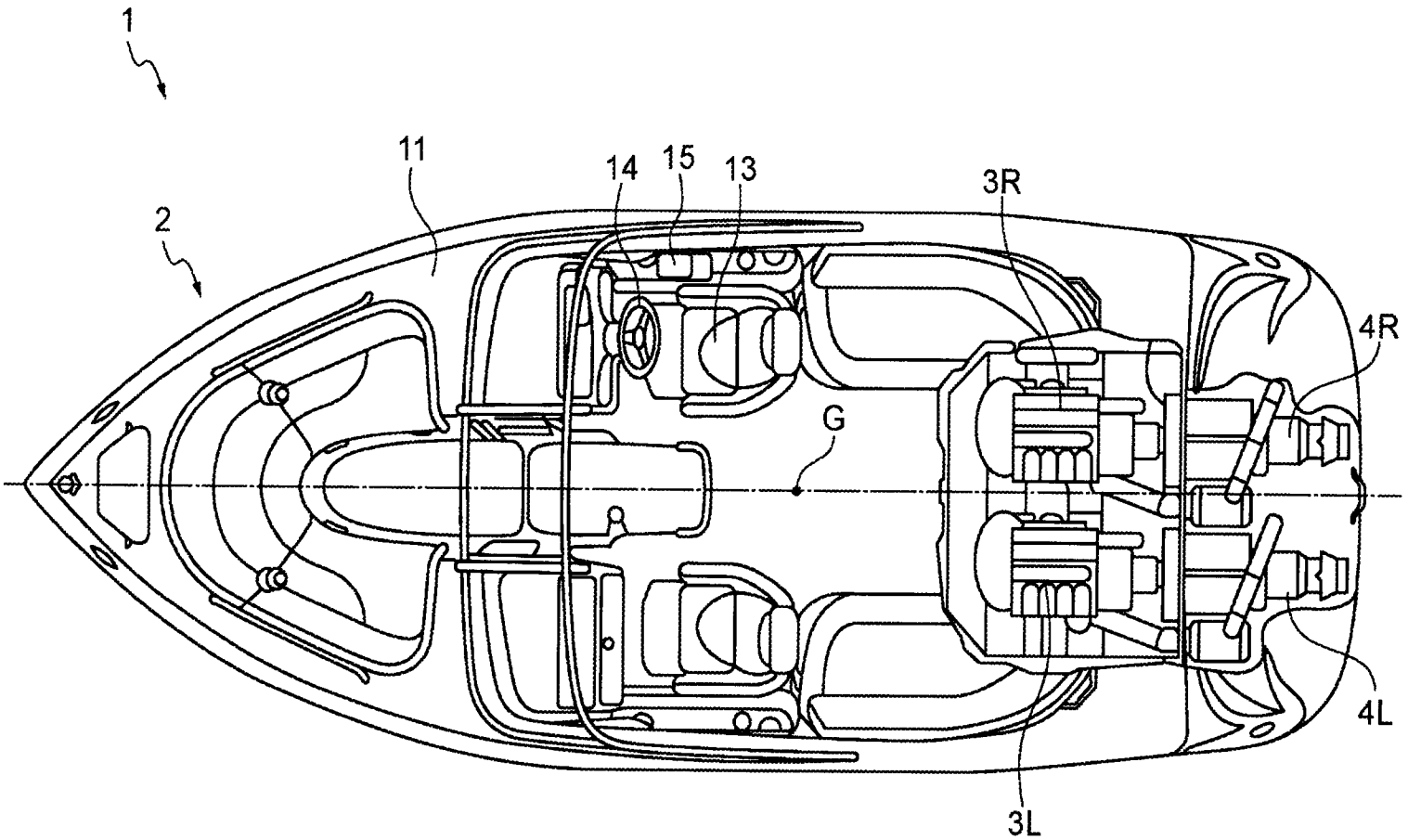
FIG. 1 is a plan view of a marine vessel to which a marine vessel maneuvering support apparatus according to a preferred embodiment of the present invention is applied.

FIG. 1 is a plan view of a marine vessel 1 to which a marine vessel maneuvering support apparatus according to a preferred embodiment of the present invention is applied.

Figure 2:
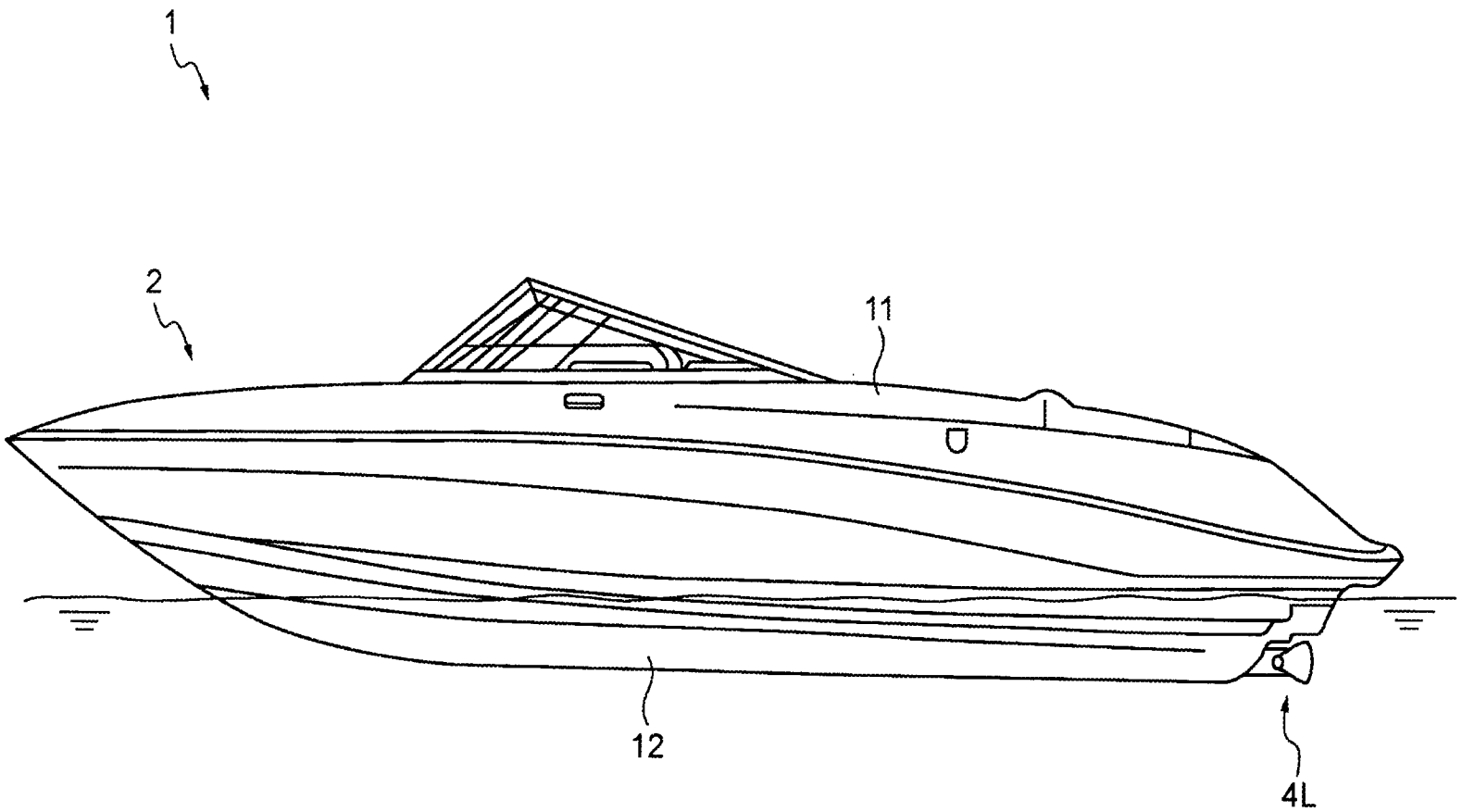
FIG. 2 is a side view of a marine vessel to which a marine vessel maneuvering support apparatus according to a preferred embodiment of the present invention is applied.

FIG. 1 shows a portion of an internal configuration of the marine vessel 1. FIG. 2 is a side view of the marine vessel 1. The marine vessel 1 is, for example, a jet propulsion boat, and is such a marine vessel called a jet boat or a sports boat.

The marine vessel 1 includes a hull 2, engines 3L and 3R, and marine vessel propulsion devices 4L and 4R. The hull 2 includes a deck 11 and a hull 12. The hull 12 is located below the deck 11. A maneuvering seat 13 is located on the deck 11. In addition, a steering apparatus 14 and a remote control unit 15 are located near the maneuvering seat 13.

The marine vessel 1 includes the engine 3L (hereinafter, also referred to as "a first engine 3L") and the engine 3R (hereinafter, also referred to as "a second engine 3R"). In addition, the marine vessel 1 includes the marine vessel propulsion device 4L (hereinafter, also referred to as "a first marine vessel propulsion device 4L") and the marine vessel propulsion device 4R (hereinafter, also referred to as "a second marine vessel propulsion device 4R"). However, the number of the engines is not limited to two, and may be three or more. Further, the number of the marine vessel propulsion devices is not limited to two, and may be three or more.

The first engine 3L and the second engine 3R are housed in the hull 2. An output shaft of the first engine 3L is connected to the first marine vessel propulsion device 4L. An output shaft of the second engine 3R is connected to the second marine vessel propulsion device 4R. The first marine vessel propulsion device 4L is driven by the first engine 3L, and generates a propulsive force (a thrust) that moves the hull 2. The second marine vessel propulsion device 4R is driven by the second engine 3R, and generates the propulsive force (the thrust) that moves the hull 2. The first marine vessel propulsion device 4L and the second marine vessel propulsion device 4R are located side by side laterally.

Figure 3:
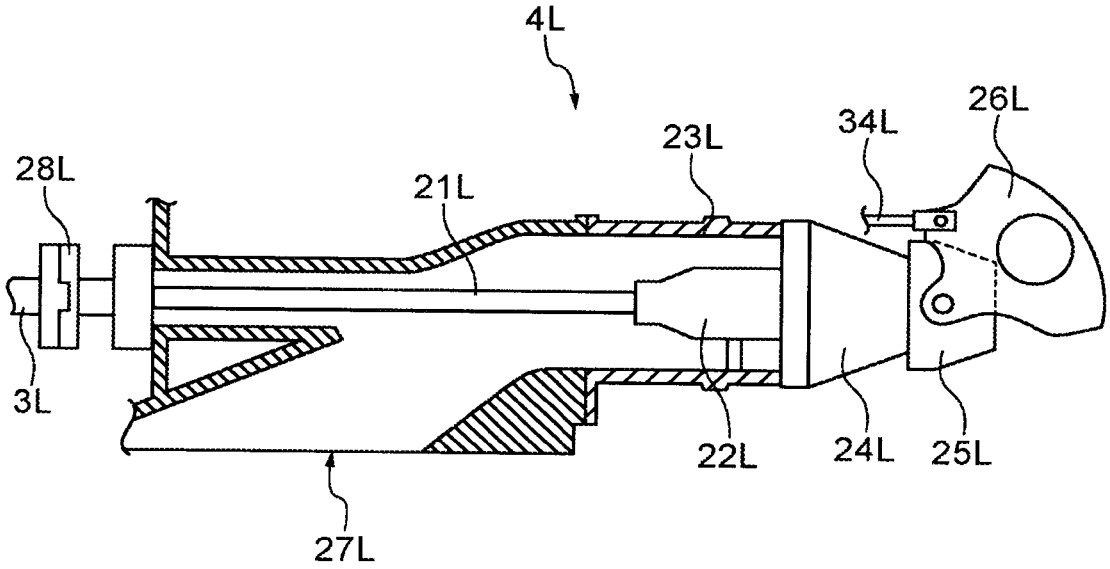
FIG. 3 is a schematic side view that shows a configuration of a first marine vessel propulsion device.

FIG. 3 is a schematic side view that shows a configuration of the first marine vessel propulsion device 4L. In FIG. 3, a portion of the first marine vessel propulsion device 4L is shown in a cross section. The first marine vessel propulsion device 4L is a jet propulsion device that sucks in water around the hull 2 and jets it out.

As shown in FIG. 3, the first marine vessel propulsion device 4L includes a first impeller shaft 21L, a first impeller 22L, a first impeller housing 23L, a first nozzle 24L, a first deflector 25L, and a first reverse bucket 26L. The first impeller shaft 21L extends in a front-rear direction. A front portion of the first impeller shaft 21L is connected to the output shaft of the first engine 3L via a coupling 28L. A rear portion of the first impeller shaft 21L is located inside the first impeller housing 23L. The first impeller housing 23L is located behind a water suction portion 27L. The first nozzle 24L is located behind the first impeller housing 23L.

The first impeller 22L is attached to the rear portion of the first impeller shaft 21L. The first impeller 22L is located inside the first impeller housing 23L. The first impeller 22L rotates together with the first impeller shaft 21L and sucks in the water from the water suction portion 27L. The first impeller 22L jets the sucked in water rearward from the first nozzle 24L.

The first deflector 25L is located behind the first nozzle 24L. The first reverse bucket 26L is located behind the first deflector 25L. The first deflector 25L is configured to change a jetting direction of the water from the first nozzle 24L to the left or the right. That is, by changing the direction of the first deflector 25L to the left or the right, a traveling direction (a moving direction) of the marine vessel 1 is changed to the left or the right.

The first reverse bucket 26L is switchable between a forward position, a reverse position, and a neutral position. When the first reverse bucket 26L is in the forward position, since the first reverse bucket 26L does not cover the first deflector 25L, the direction of the jet flow from the first nozzle 24L is changed to the rear of the hull 2. As a result, the marine vessel 1 moves forward. When the first reverse bucket 26L is in the reverse position, since the first reverse bucket 26L covers the first deflector 25L, the direction of the jet flow from the first nozzle 24L is changed to the front of the hull 2. As a result, the marine vessel 1 moves backward.

Here, the neutral position of the first reverse bucket 26L is a position between the forward position and the reverse position. When the first reverse bucket 26L is in the neutral position, since the first reverse bucket 26L covers a portion of the first deflector 25L, the direction of the jet flow from the first nozzle 24L is changed to the left or the right of the hull 2. Therefore, in the neutral position, the first reverse bucket 26L reduces a propulsive force (a thrust) that moves the hull 2 forward. As a result, either the hull 2 is slowed down or the hull 2 is held at a stop position. Although illustration is omitted, the second marine vessel propulsion device 4R is configured similarly to the first marine vessel propulsion device 4L.

Figure 4:
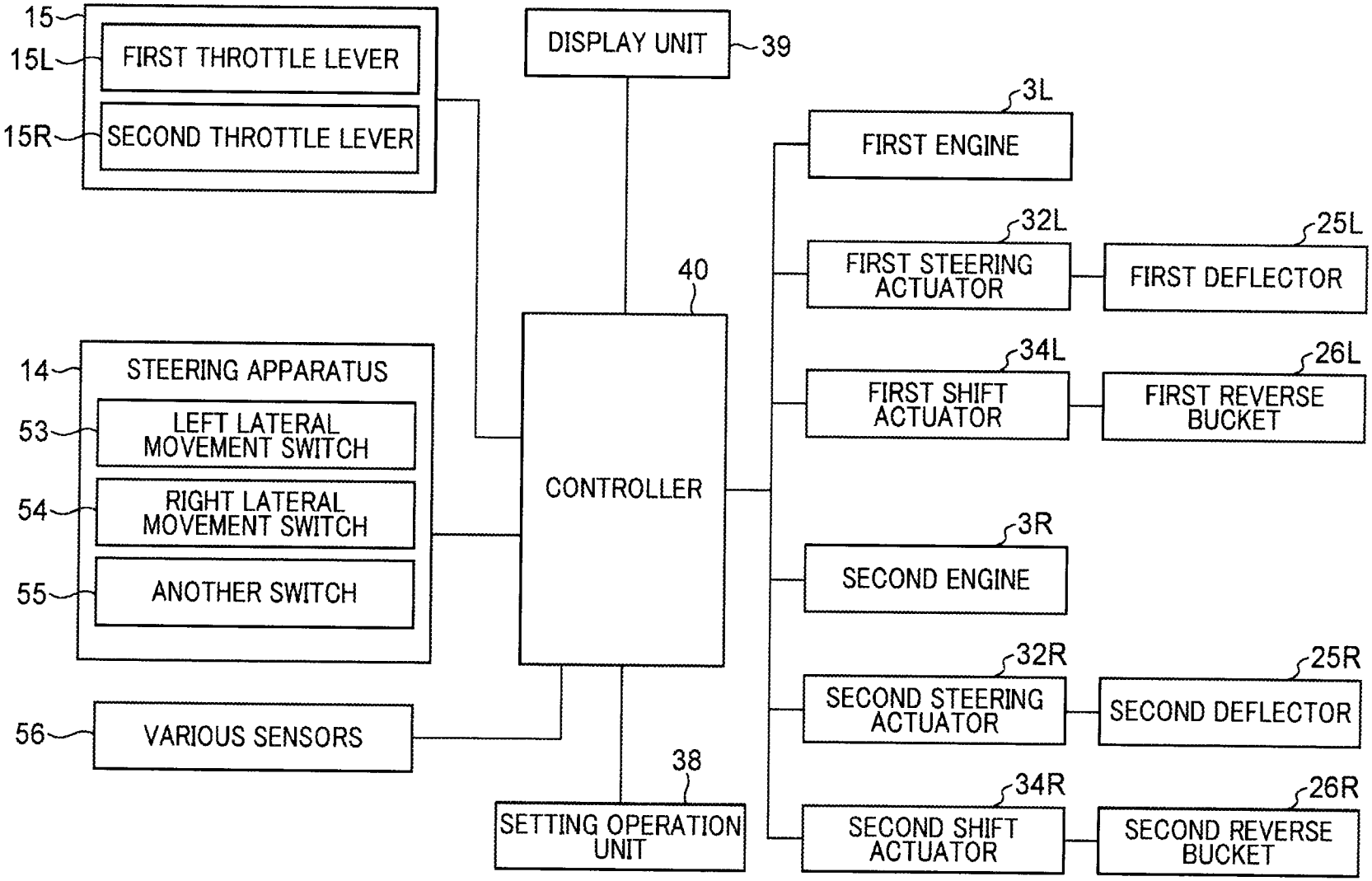
FIG. 4 is a block diagram of a control system of the marine vessel including a marine vessel maneuvering support system.

Next, a control system of the marine vessel 1 will be described. FIG. 4 is a block diagram of the control system of the marine vessel 1 including a marine vessel maneuvering support system according to a preferred embodiment of the present invention.

The marine vessel maneuvering support system includes a controller 40 (a controller) that functions as the marine vessel maneuvering support apparatus according to a preferred embodiment of the present invention. The controller 40 includes a processor (not shown) such as a CPU (Central Processing Unit) and storage devices (not shown) such as a RAM (Random Access Memory) and a ROM (Read Only Memory), and is programmed so as to control the marine vessel 1.

The marine vessel 1 includes a first steering actuator 32L and a first shift actuator 34L. The controller 40 is communicably connected to the first engine 3L, the first steering actuator 32L, and the first shift actuator 34L.

The first steering actuator 32L is connected to the first deflector 25L of the first marine vessel propulsion device 4L. The first steering actuator 32L changes a steering angle of the first deflector 25L. The first steering actuator 32L includes, for example, an electric motor. Alternatively, the first steering actuator 32L may be another actuator such as a hydraulic cylinder.

The first shift actuator 34L is connected to the first reverse bucket 26L of the first marine vessel propulsion device 4L. The first shift actuator 34L switches the position of the first reverse bucket 26L between the forward position, the reverse position, and the neutral position. The first shift actuator 34L includes, for example, an electric motor. Alternatively, the first shift actuator 34L may be another actuator such as a hydraulic cylinder.

The marine vessel 1 includes a second steering actuator 32R and a second shift actuator 34R. The second steering actuator 32R is connected to a second deflector 25R of the second marine vessel propulsion device 4R. The second shift actuator 34R is connected to a second reverse bucket 26R of the second marine vessel propulsion device 4R. These configurations are devices to control the second marine vessel propulsion device 4R, and are the same configurations as the configuration of the first steering actuator 32L and the configuration of the first shift actuator 34L that are described above. The controller 40 is communicably connected to the second steering actuator 32R and the second shift actuator 34R.

The controller 40 may be a single apparatus, or may be a plurality of separate control units. The controller 40 is communicably connected to the steering apparatus 14 and the remote control unit 15. It should be noted that the controller 40 may obtain a voltage detected by a sensor (not shown) of the remote control unit 15 as a signal.

The remote control unit 15 is operated to adjust outputs of the engines 3L and 3R and switch between forward moving and backward movement. The remote control unit 15 includes a first throttle lever 15L and a second throttle lever 15R. The first throttle lever 15L and the second throttle lever 15R are operable in a forward moving direction and in a backward moving direction from zero operation positions, respectively.

The remote control unit 15 outputs signals that indicate operation amounts and operation directions of the first throttle lever 15L and the second throttle lever 15R. In a normal marine vessel maneuvering mode (described below), the controller 40 controls a rotational speed of the first engine 3L in response to the operation amount of the first throttle lever 15L. The controller 40 controls a rotational speed of the second engine 3R in response to the operation amount of the second throttle lever 15R. The controller 40 controls the first shift actuator 34L in response to the operation direction of the first throttle lever 15L. The controller 40 controls the second shift actuator 34R in response to the operation direction of the second throttle lever 15R. As a result, switching between the forward movement and the backward movement of the marine vessel 1 is performed.

The marine vessel 1 includes a display unit 39 and a setting operation unit 38. The display unit 39 includes a display and displays various kinds of information based on instructions from the controller 40. The setting operation unit 38 includes an operation element (not shown) to perform operations related to marine vessel maneuvering, a setting operation element (not shown) to perform various kinds of settings, and an inputting operation element (not shown) to input various kinds of instructions. Signals inputted by the setting operation unit 38 are supplied to the controller 40.

The steering apparatus 14 includes a wheel portion (not shown) that is rotatable, a left lateral movement switch 53, a right lateral movement switch 54, and another switch 55. The wheel portion, the left lateral movement switch 53, the right lateral movement switch 54, and the another switch 55 are able to be operated by a marine vessel user, and their operation signals are supplied to the controller 40.

In addition, various sensors 56 are provided on the hull 2. Detection signals from the various sensors 56 are supplied to the controller 40. The various sensors 56 include a direction sensor (not shown), a marine vessel speed sensor (not shown), a distance sensor (not shown), a position sensor (not shown), etc. The direction sensor (an azimuth sensor) detects a direction of the hull 2 (an azimuth of the hull 2). The marine vessel speed sensor detects a navigating speed of the hull 2. The distance sensor detects a relative distance between the hull 2 and a target (a pier or the like) by, for example, an optical way. The position sensor includes a GPS (Global Positioning System) receiver, etc., and detects the current position of the hull 2. The configuration of each sensor of the various sensors 56 is not limited to the one described above.

Here, various kinds of marine vessel maneuvering modes will be described. The marine vessel maneuvering modes are roughly divided into "the normal marine vessel maneuvering mode" and "lateral movement modes". The lateral movement modes include a left lateral movement mode and a right lateral movement mode. When the left lateral movement switch 53 is pressed, the left lateral movement mode is executed, and when the right lateral movement switch 54 is pressed, the right lateral movement mode is executed.

In the normal marine vessel maneuvering mode, the controller 40 controls a bow direction of the hull 2 in response to a rotation of the wheel portion of the steering apparatus 14. The steering apparatus 14 outputs an operation signal, which indicates an operation position of the wheel portion, to the controller 40. The controller 40 controls the steering actuators 32L and 32R in response to the rotation of the wheel portion. As a result, the bow direction of the hull 2 is changed to the left or the right. In addition, in the normal marine vessel maneuvering mode, the controller 40 controls the engines 3L and 3R and the marine vessel propulsion devices 4L and 4R in response to the operation of the remote control unit 15.

The lateral movement mode generates a thrust that causes the hull 2 to move in parallel with a lateral direction. The left lateral movement mode controls the engines 3L and 3R and the marine vessel propulsion devices 4L and 4R so as to laterally move the hull 2 leftward. The right lateral movement mode controls the engines 3L and 3R and the marine vessel propulsion devices 4L and 4R so as to laterally move the hull 2 rightward.

Here, moving in parallel means that the hull 2 moves in a horizontal direction without rotating in a yaw direction around the center of gravity G (see FIG. 1). For example, in the lateral movement mode without pivot turning, the center of gravity G of the hull 2 moves leftward or rightward.

Figure 5:
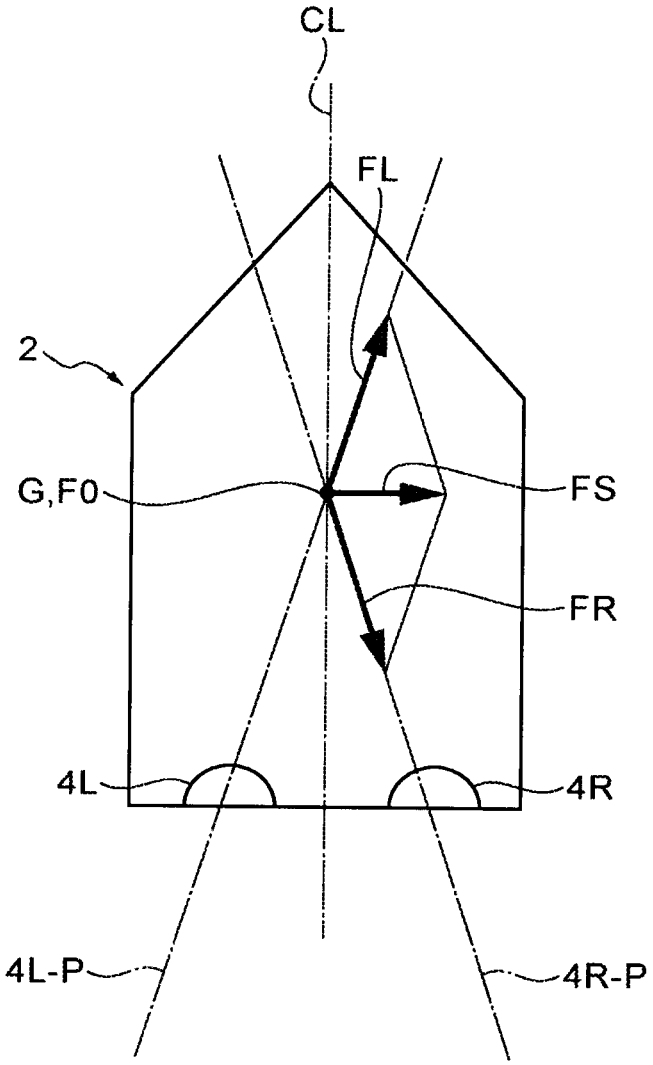
FIG. 5 is a schematic diagram that shows first and second thrusts acting on a hull in a lateral movement mode.

FIG. 5 is a schematic diagram that shows first and second thrusts acting on the hull 2 in the lateral movement mode. The shape of the hull 2 is shown schematically. For the sake of convenience, it is assumed that a rotation center position when the hull 2 pivot-turns coincides with the center of gravity G. It should be noted that the center of gravity G may be the resistance center of gravity of the hull 2. In addition, it is assumed that the first marine vessel propulsion device 4L and the second marine vessel propulsion device 4R are located at left and right symmetrical positions with respect to a center line of the hull 2 in the front-rear direction. Moreover, a line, which extends through the center of gravity G of the hull 2 and is parallel to the front-rear direction, is defined as a central line CL.

FIG. 5 shows the first thrust and the second thrust acting on the hull 2 in the right lateral movement mode. As shown in FIG. 5, in the right lateral movement mode, a first thrust acting line 4L-P of the first marine vessel propulsion device 4L and a second thrust acting line 4R-P of the second marine vessel propulsion device 4R intersect at the center of gravity G. In this case, a first thrust FL of the first marine vessel propulsion device 4L is a vector facing to front right (a forward right vector), and a second thrust FR of the second marine vessel propulsion device 4R is a vector facing to rear right (a rearward right vector). A resultant force of the first thrust FL and the second thrust FR becomes a resultant force FS. The resultant force FS becomes a vector facing to the right. Therefore, the resultant force FS, which faces to the right, acts as a thrust on the hull 2 with the center of gravity G as an acting point F0. Therefore, since no rotational moment acts on the hull 2, the hull 2 moves in parallel with the lateral direction rightward without pivot-turning. In addition, in the case of the left lateral movement mode, it can be understood that the left direction and the right direction are reversed with respect to the example shown in FIG. 5. It should be noted that the acting point F0 corresponds to an intersection point of a vector direction of the resultant force FS and the central line CL when viewed from a vertical direction.

The acting point F0 varies depending on an angle formed by the first thrust acting line 4L-P and the central line CL and an angle formed by the second thrust acting line 4R-P and the central line CL, and further varies depending on an angle formed by the first thrust acting line 4L-P and the second thrust acting line 4R-P. For example, when the angle formed by the first thrust acting line 4L-P and the central line CL and the angle formed by the second thrust acting line 4R-P and the central line CL are common (when the angle formed by the first thrust acting line 4L-P and the central line CL is equal to the angle formed by the second thrust acting line 4R-P and the central line CL), the acting point F0 is located on the central line CL. In this case, the larger the angle formed in the rear by the first thrust acting line 4L-P and the second thrust acting line 4R-P, the more rearward the acting point F0 is located on the central line CL.

When the magnitude or the direction of either the first thrust FL or the second thrust FR changes, the position of the acting point F0 and the magnitude or the direction of the resultant force FS change. For example, even in cases where the acting point F0 is the same, when the magnitude of either the first thrust FL or the second thrust FR changes, sometimes the vector direction of the resultant force FS will become an oblique lateral direction or the front-rear direction.

FIGS. 6A to 6D are transition diagrams that show a behavior of the hull 2 during the lateral movement mode. FIGS. 6A to 6D show a change in the resultant force FS and the movement of the hull 2 after the start of the lateral movement mode until the hull 2 approaches a shore 19 such as a pier or the like and comes alongside the shore 19 (that is, becomes a coming-alongside state). Pressing the left lateral movement switch 53 or the right lateral movement switch 54 corresponds to an instruction to laterally move the hull 2. It is assumed that the instruction to laterally move the hull 2 is accepted when the hull 2 is substantially stationary, but the instruction to laterally move the hull 2 is not limited to being accepted while the hull 2 is stationary. Although FIGS. 6A to 6D show the case of the right lateral movement mode, in the case of the left lateral movement mode, it can be understood that the left direction and the right direction are reversed with respect to each of FIGS. 6A to 6D.

Figure 6A:
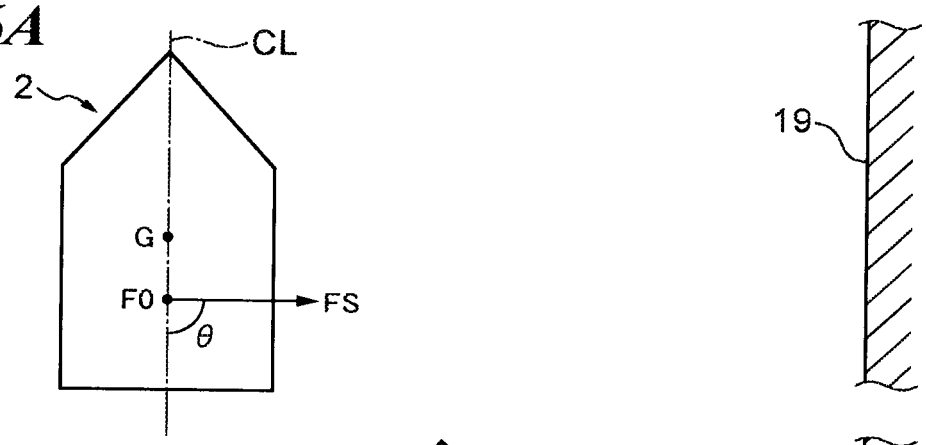
FIGS. 6A to 6D are transition diagrams that show a behavior of the hull during the lateral movement mode.

When the right lateral movement switch 54 is pressed, the right lateral movement mode is started (see FIG. 6A). In order to hasten the start of the movement of the hull 2, the controller 40 controls the marine vessel propulsion devices 4L and 4R so as to generate a thrust to pivot-turn the hull 2 at the start of the lateral movement mode. Here, as an example, the controller 40 controls the marine vessel propulsion devices 4L and 4R so as to set the position of the acting point F0 to the rear of the center of gravity G, and to set the vector direction of the resultant force FS to the rightward (the lateral direction) with respect to the hull 2.

Here, the lateral direction is a direction perpendicular to the central line CL when viewed from above. That is, when an angle formed in an instruction direction and in the rear by the vector direction of the resultant force FS, which is the lateral direction, and the central line CL is defined as θ, the angle θ is 90°.

Then, the hull 2 first pivot-turns counterclockwise when viewed from above (the vertical direction). Concurrently with the pivot-turning or immediately after the pivot-turning starts, the hull 2 also starts to move the rightward. In general, when the hull 2 starts to move laterally from a stationary state, since a large load due to the water resistance and an inertia moment of the hull 2 is applied to the hull 2, if the position of the acting point F0 coincides with the center of gravity G, the start of the movement of the hull 2 is delayed (slows down). In order to deal with this issue, in a preferred embodiment of the present invention, since the hull 2 pivot-turns first, the subsequent lateral movement becomes smooth.

Figure 6B:
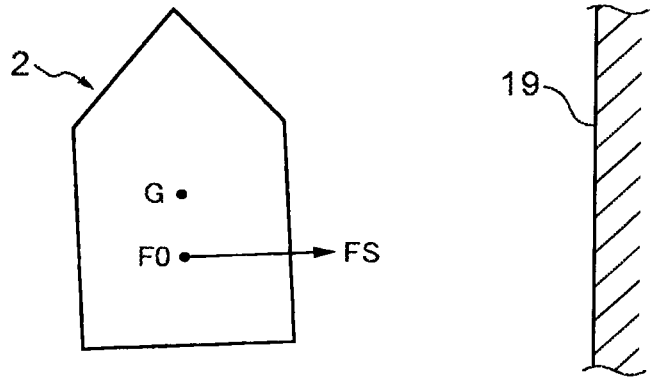
Figure 6C:
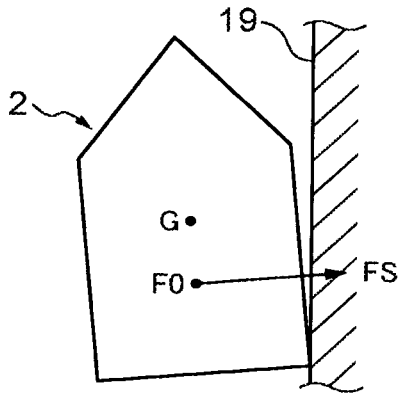

After the hull 2 pivot-turns, when the position and the direction of the resultant force FS are maintained, the hull 2 moves rightward while pivot-turning (see FIG. 6B). Then, the hull 2 eventually comes into contact with the shore 19. Although it depends on an initial attitude of the hull 2, the stern of the hull 2 often comes into contact with the shore 19 earlier than the bow of the hull 2 due to the counterclockwise pivot-turning of the hull 2. It should be noted that when the stern or the bow of the hull 2 comes into contact with the shore 19, a frictional force generated is larger than when the side portion of the hull 2 comes into contact with the shore 19, making it difficult for the hull 2 to drift away.

After that, the position of the resultant force FS (the position of the acting point F0) and the direction of the resultant force FS are maintained until an end condition (a predetermined condition), which will be described below, is satisfied. When the hull 2 docks as it is, in general, the hull 2 gradually becomes parallel to the shore 19. Then, when the end condition is satisfied, the controller 40 shifts to a lateral thrust generation mode. The lateral thrust generation mode is a final mode in the lateral movement mode. The lateral thrust generation mode controls the engines 3L and 3R and the marine vessel propulsion devices 4L and 4R so that the hull 2 comes alongside a docking place such as a pier and a state in which the hull 2 is pressed against the docking place (hereinafter, referred to as "a pressing state") is maintained.

In the lateral thrust generation mode, the controller 40 applies a thrust in the lateral direction (a lateral thrust) to the hull 2 without applying a pivot-turning force to the hull 2. In other words, the controller 40 makes the position of the acting point F0 coincide with the center of gravity G, and maintains the vector direction of the resultant force FS in the lateral direction (to the rightward in FIG. 6D) with respect to the hull 2.

In the lateral thrust generation mode, the magnitude of the resultant force FS may be made smaller than that at the start of the lateral movement mode. By doing so, a control state similar to a so-called pressing mode is obtained. Alternatively, after a certain period of time has elapsed since shifting to the lateral thrust generation mode, the magnitude of the resultant force FS may be made smaller than that at the start of the lateral movement mode.

In this way, the controller 40 first generates the thrust to pivot-turn the hull 2, and thereafter (when the end condition is satisfied), applies the thrust in the lateral direction (the lateral thrust) to the hull 2. Substantially, the controller 40 performs a control so that a pivot-turning speed of the hull 2 decreases after generating the thrust to pivot-turn the hull 2 (the resultant force FS).

Here, the state of the lateral movement mode is considered as follows from a vector viewpoint. The controller 40 performs the control so as to shift the acting point F0 of the resultant force FS at the start of the lateral movement mode from the center of gravity G in the front-rear direction when viewed from the vertical direction and then bring the acting point F0 closer to the center of gravity G. After that, the controller 40 makes the acting point F0 coincide with the center of gravity G, and makes the direction of the vector of the resultant force FS become the lateral direction corresponding to the instruction to laterally move the hull 2.

Figure 7:
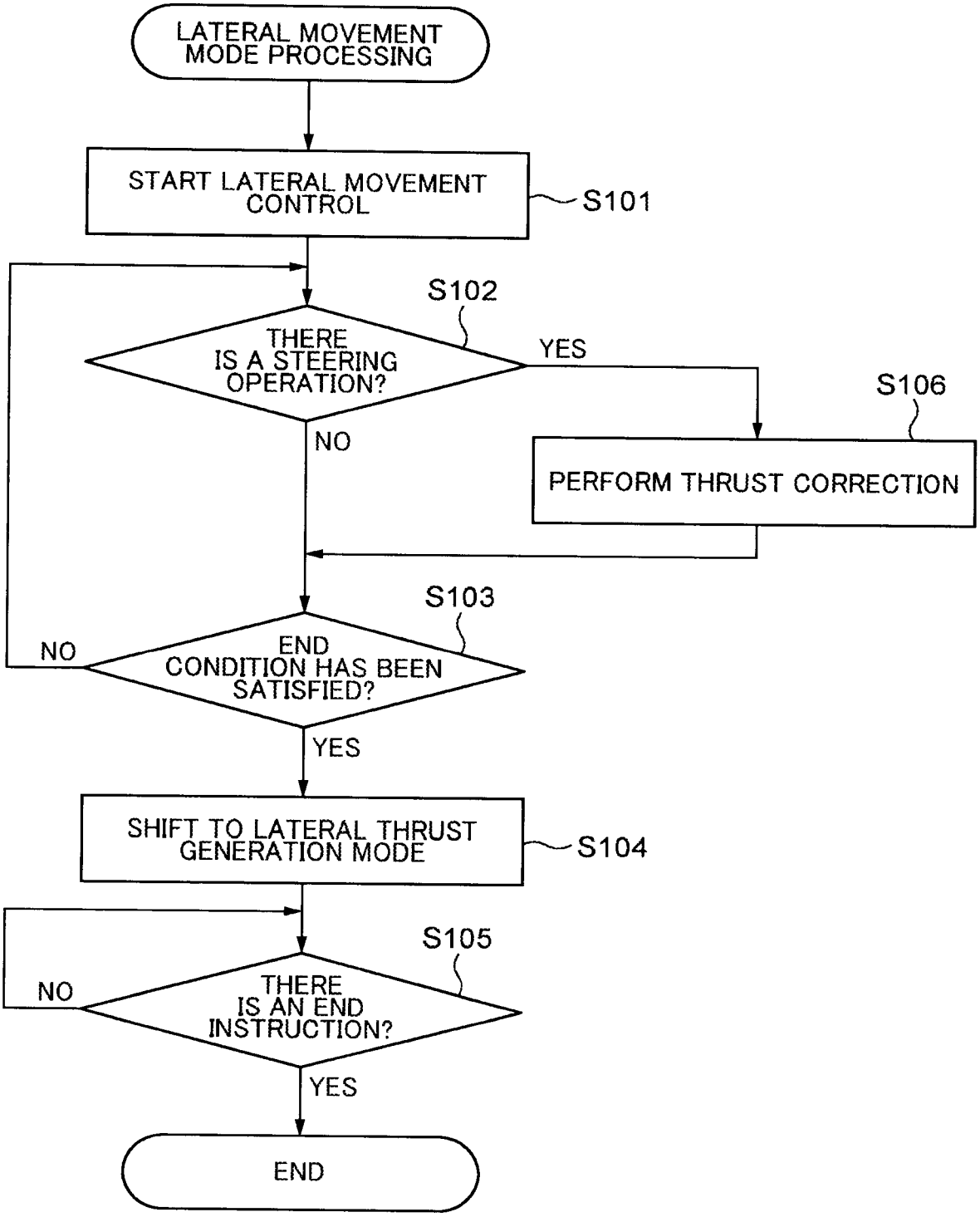
FIG. 7 is a flow chart that shows the flow of a lateral movement mode process.

FIG. 7 is a flow chart that shows the flow of a lateral movement mode process. In the controller 40, the lateral movement mode process is realized by the CPU expanding a program, which is stored in the ROM, to the RAM and executing the program. The lateral movement mode process is started in response to a pressing operation of the left lateral movement switch 53 or the right lateral movement switch 54 in the normal marine vessel maneuvering mode.

In step S101, the controller 40 starts a lateral movement control in the lateral movement mode. That is, the controller 40 controls the marine vessel propulsion devices 4L and 4R to generate the thrust to pivot-turn the hull 2 (see FIG. 6A). In step S102, the controller 40 determines based on the operation signal from the steering apparatus 14 whether or not there has been a steering operation (the rotation of the wheel portion of the steering apparatus 14). In the case it is determined that the steering operation has occurred, the controller 40 advances the lateral movement mode process to step S106. On the other hand, in the case it is determined that no steering operation has occurred, the controller 40 advances the lateral movement mode process to step S103.

In step S103, the controller 40 determines whether or not the end condition has been satisfied. Here, as an example, the end condition is that a predetermined period of time has elapsed from the start of the lateral movement mode (hereinafter, referred to as "a condition A"). In other words, when the predetermined period of time has elapsed since the start of the lateral movement mode, the controller 40 determines that the end condition has been satisfied. The predetermined period of time is set to, for example, a length equal to or longer than a time normally required from the start of docking until docking.

It should be noted that the end condition is not limited to the condition A. The controller 40 may determine whether or not the end condition has been satisfied, based on at least one of an elapsed time since the start of the lateral movement mode, a change in the direction of the hull 2 from the start of the lateral movement mode, a speed of the hull 2, a distance from the hull 2 to a movement target position (for example, the shore 19), a change in a position of the hull 2 from the start of the lateral movement mode, or an input from the marine vessel user. Specifically, the controller 40 may determine that the end condition has been satisfied based on that at least one of the condition A, a condition B, a condition C, a condition D, a condition E, or a condition F has been satisfied. Examples of the condition B, the condition C, the condition D, the condition E, or the condition F are shown below.

The condition B is that the change in the direction of the hull 2 from the start of the lateral movement mode exceeds a predetermined amount. In other words, the condition B is that a change amount of a pivot-turning angle of the hull 2 from the start of the lateral movement mode exceeds the predetermined amount. Whether or not the condition B has been satisfied is determined based on the detection result of the direction sensor included in the various sensors 56. The condition C is that a speed component of the hull 2 in the instruction direction (rightward or leftward) exceeds a predetermined speed. Whether or not the condition C has been satisfied is determined based on the detection result of the marine vessel speed sensor included in the various sensors 56 (the speed of the hull 2 detected by the marine vessel speed sensor). The condition D is that the distance from the hull 2 to the movement target position (for example, the shore 19) is within a predetermined distance. Whether or not the condition D has been satisfied is determined based on the detection result of the distance sensor included in the various sensors 56.

The condition E is that the change in the position of the hull 2 from the start of the lateral movement mode exceeds a predetermined value. Whether or not the condition E has been satisfied is determined based on the detection result of the position sensor included in the various sensors 56. The condition F is that an instruction to apply the thrust in the lateral direction (the lateral thrust) to the hull 2 has been inputted by the marine vessel user. For example, the marine vessel user is able to input the instruction to apply the thrust in the lateral direction (the lateral thrust) to the hull 2 by operating the another switch 55. The controller 40 is able to determine whether or not the condition F has been satisfied based on whether or not the instruction to apply the thrust in the lateral direction to the hull 2 has been inputted.

In the case that the condition A, the condition D, or the condition E is used, it is possible to shift to the pressing state in a situation where the hull 2 is expected to come alongside. In the case that the condition B is used, it is possible to shift to the pressing state in a situation where the hull 2 is not excessively inclined with respect to the shore 19. In the case that the condition C is used, it is possible to hasten shifting to the pressing state. In the case that the condition F is used, it is possible to shift to the pressing state at a timing desired by the marine vessel user.

In the case it is determined in step S103 that the end condition has not been satisfied, the controller 40 returns the lateral movement mode process to step S102. Therefore, a thrust generated at the start of the lateral movement control (the thrust to pivot-turn the hull 2) is maintained (see FIGS. 6B and 6C). On the other hand, in the case it is determined in step S103 that the end condition has been satisfied, the controller 40 advances the lateral movement mode process to step S104.

Figure 6D:
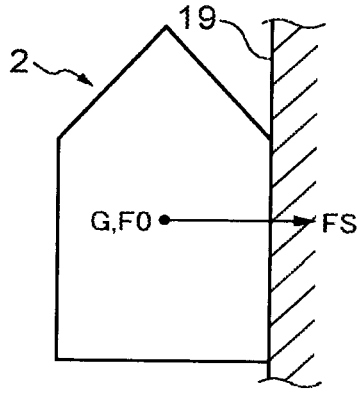

In step S104, the controller 40 shifts to the lateral thrust generation mode (see FIG. 6D). That is, by making the position of the acting point F0 coincide with the center of gravity G and making the vector direction of the resultant force FS become the lateral direction perpendicular to the central line CL, the controller 40 applies the thrust in the lateral direction to the hull 2 without applying the pivot-turning force to the hull 2.

In step S105, the controller 40 waits until there is an instruction to end the lateral movement mode. Therefore, the lateral thrust generation mode is continued. The instruction to end the lateral movement mode is able to be inputted, for example, by the marine vessel user operating the setting operation unit 38. In the case that there has been the instruction to end the lateral movement mode, the controller 40 ends the lateral movement mode process shown in FIG. 7.

In step S106, the controller 40 performs a thrust correction in response to the accepted steering operation, and advances the lateral movement mode process to step S103. Examples of the thrust correction will be described with reference to FIG. 8 and FIG. 9.

Figure 8:
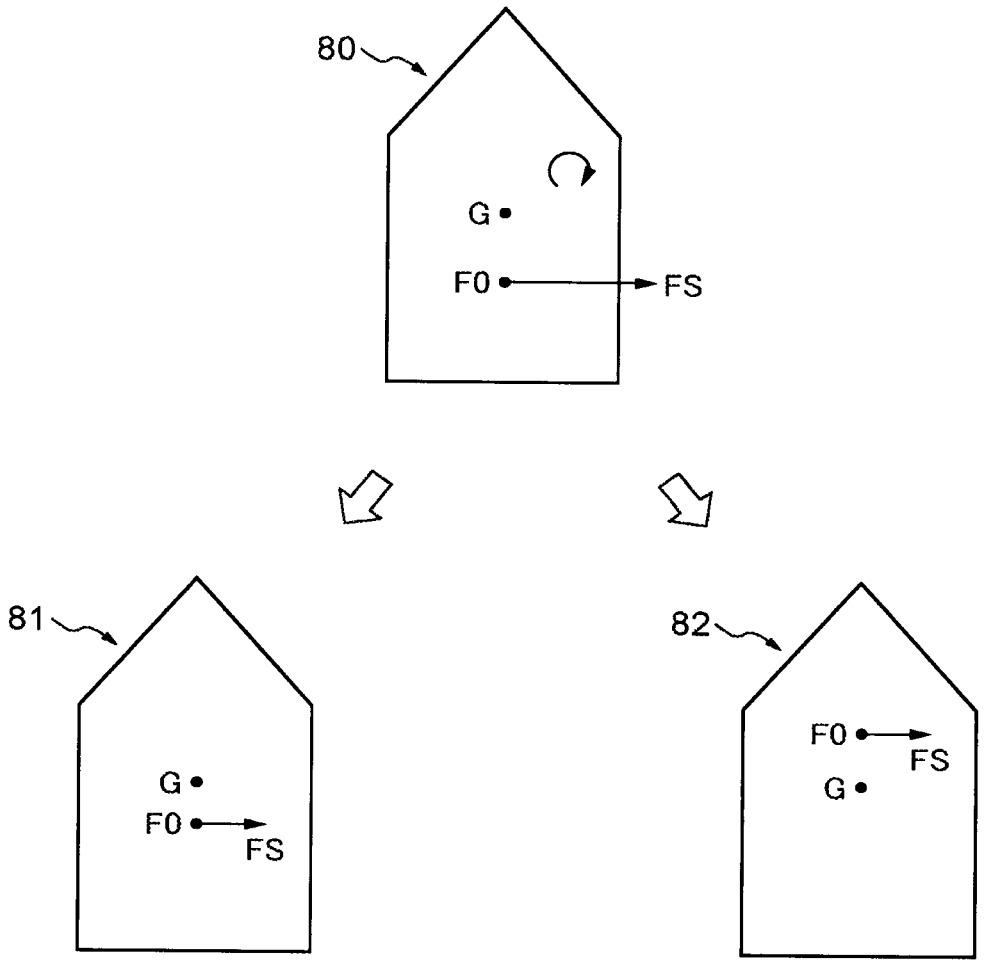
FIG. 8 is a schematic diagram that shows a change in a resultant force FS when a steering operation is accepted after starting the lateral movement mode.
Figure 9:
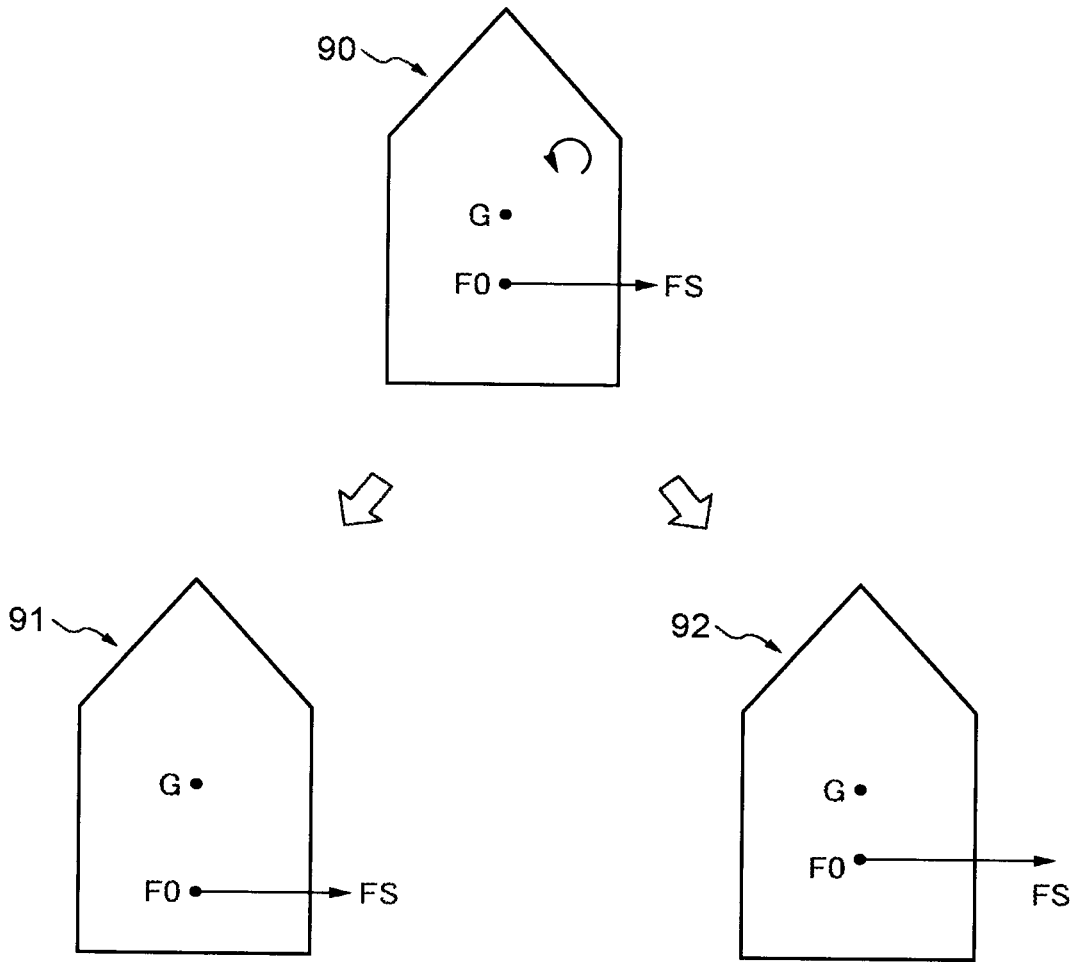
FIG. 9 is a schematic diagram that shows the change in the resultant force FS when the steering operation is accepted after starting the lateral movement mode.

FIG. 8 and FIG. 9 are schematic diagrams that show a change in the resultant force FS when the steering operation is accepted after starting the lateral movement mode. FIG. 8 and FIG. 9 do not show a change in the attitude of the hull 2. Hereinafter, the length of an arrow indicating the vector of the resultant force FS corresponds to the magnitude of the resultant force FS, and the longer the arrow, the larger the magnitude of the resultant force FS.

After generating the thrust to pivot-turn the hull 2, when accepting the steering operation, the controller 40 corrects the pivot-turning speed of the hull 2 in response to the accepted steering operation. As a result, a pivot-turning radius or a pivot-turning direction may also be corrected.

For example, as shown in a case 80 of FIG. 8, consider the case that a steering operation to turn the rightward (clockwise) is accepted after generating a resultant force FS to pivot-turn the hull 2 counterclockwise. In this case, as shown in a case 81 of FIG. 8, the controller 40 brings the position of the acting point F0 closer to the center of gravity G, or decreases the magnitude of the resultant force FS. It should be noted that in the case 81, the controller 40 may bring the position of the acting point F0 closer to the center of gravity G and decrease the magnitude of the resultant force FS. Alternatively, as shown in a case 82 of FIG. 8, the controller 40 locates the position of the acting point F0 at an opposite position in the front-rear direction with respect to the center of gravity G. At that time, the magnitude of the resultant force FS does not matter, and it may be smaller than the initial value. Due to the controller 40 executing the control shown in the case 81 or the case 82, a counterclockwise pivot-turning speed of the hull 2 is decreased.

Next, as shown in a case 90 of FIG. 9, consider the case that a steering operation to turn the leftward (counterclockwise) is accepted after generating the resultant force FS to pivot-turn the hull 2 counterclockwise. In this case, as shown in a case 91 of FIG. 9, the controller 40 moves the position of the acting point F0 rearward so as to move away from the center of gravity G. Alternatively, as shown in a case 92 of FIG. 9, the controller 40 increases the magnitude of the resultant force FS. It should be noted that the controller 40 may move the position of the acting point F0 rearward so as to move away from the center of gravity G and increase the magnitude of the resultant force FS. Due to the controller 40 executing the control shown in the case 91 and/or the case 92, the counterclockwise pivot-turning speed of the hull 2 is increased.

It should be noted that the vector direction of the thrust to change the pivot-turning speed of the hull 2 is not limited to the lateral direction. Therefore, every time a steering operation is accepted, the pivot-turning speed of the hull 2 may be changed by changing at least one of the position of the acting point F0, the magnitude of the resultant force FS, or the vector direction of the resultant force FS in response to the accepted steering operation. It should be noted that it is not essential to perform the thrust correction in response to the steering operation. Therefore, steps S102 and S106 may be eliminated in the lateral movement mode process shown in FIG. 7.

According to a preferred embodiment of the present invention, the controller 40 executes the lateral movement mode, in which the thrust in the lateral direction is applied to the hull 2, by controlling the propulsion devices (the engines 3L and 3R and the marine vessel propulsion devices 4L and 4R) in response to receiving the instruction to laterally move the hull 2. The controller 40 controls the propulsion devices (the engines 3L and 3R and the marine vessel propulsion devices 4L and 4R) so as to generate the thrust to pivot-turn the hull 2 at least at the start of the lateral movement mode. As a result, since it is possible to hasten the start of the movement of the hull 2, it is possible to make the lateral movement of the hull 2 become smooth. For example, at the time of the lateral movement of the hull 2 for docking, it is possible to hasten the docking regardless of the degree of mastery of operation skills.

In addition, since the controller 40 applies the thrust in the lateral direction to the hull 2 after generating the thrust to pivot-turn the hull 2, it is possible to shift to the pressing state. In particular, since the controller 40 applies the thrust in the lateral direction to the hull 2 in response to the establishment of the predetermined condition, it is possible to shift to the pressing state at an appropriate timing after starting the lateral movement of the hull 2.

It should be noted that the thrust to pivot-turn the hull 2 at the start of the lateral movement mode is not limited to the examples described above. In addition, in a period between the start of the lateral movement mode and the lateral thrust generation mode, which is the final mode in the lateral movement mode, the controller 40 may generate a thrust that is different from both the thrust at the start of the lateral movement mode and the thrust in the lateral thrust generation mode (at least one of the acting position (that is, the position of the acting point F0) of the thrust, the magnitude of the thrust, or the direction of the thrust is different from that of both the thrust at the start of the lateral movement mode and the thrust in the lateral thrust generation mode). Modifications relating to the thrust will be described below with reference to FIGS. 10A to 10D, 11, 12, 13, and 14.

FIGS. 10A to 10D are schematic diagrams that show modifications of the thrust acting on the hull 2 at the start of the lateral movement mode. In all of FIGS. 10A to 10D, it is assumed that an instruction to laterally move rightward is received.

Figure 10A:
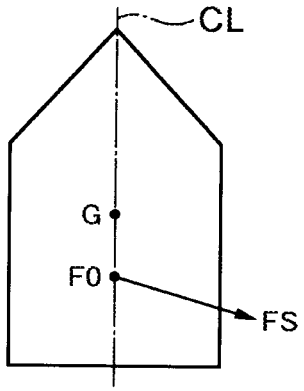
FIGS. 10A to 10D are schematic diagrams that show modifications of a thrust acting on the hull at the start of the lateral movement mode.
Figure 10B:
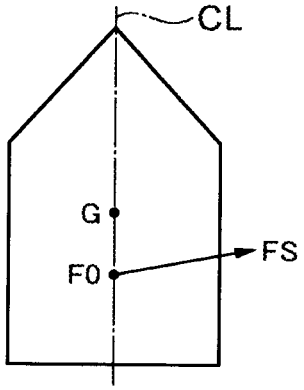

The vector direction of the resultant force FS at the start of the lateral movement mode does not necessarily have to be the lateral direction, and as shown in FIGS. 10A and 10B, may be oblique (a direction not perpendicular to the central line CL when viewed from above). Even by using such a resultant force FS, it is possible to pivot-turn the hull 2 at the start of the lateral movement mode.

Figure 10C:
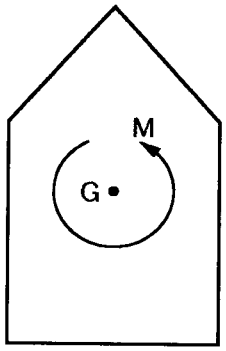

Further, the resultant force FS at the start of the lateral movement mode does not necessarily have a leftward component or a rightward component. For example, as shown in FIG. 10C, the resultant force FS at the start of the lateral movement mode may be a thrust that causes the hull 2 to generate a counterclockwise rotational moment M about the center of gravity G. Therefore, the pivot-turning of the hull 2 at the start of the lateral movement mode also includes the rotation of the hull 2 about the center of gravity G.

Figure 10D:
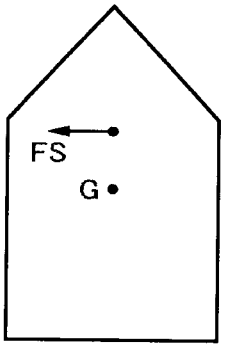

In the examples shown in FIGS. 6A to 6D, the vector direction of the thrust to pivot-turn the hull 2 at the start of the lateral movement mode is set to a direction corresponding to the instruction to laterally move the hull 2 (rightward in FIG. 6A). This is because it is advantageous to provide an efficient start of the movement of the hull 2 and a natural control. However, the resultant force FS at the start of the lateral movement mode is not limited to this, and may include a component in a direction opposite to the instruction direction, which is the direction corresponding to the instruction to laterally move the hull 2. For example, in the case that the instruction to laterally move rightward is received, as shown in FIG. 10D, the controller 40 may apply a resultant force FS including a leftward component to the hull 2 to pivot-turn the hull 2 at the start of the lateral movement mode, and then, may apply a resultant force FS, which includes a rightward component corresponding to the instruction to laterally move rightward, to the hull 2.

In the examples shown in FIGS. 6A to 6D and 10A to 10D, the pivot-turning direction of the hull 2 at the start of the lateral movement mode corresponds to a direction in which the stern approaches the direction corresponding to the instruction to laterally move the hull 2. This is because moving the stern, which is close to the marine vessel propulsion devices, requires less energy to start moving the hull 2 than moving the bow, which is far from the marine vessel propulsion devices. However, the pivot-turning direction of the hull 2 at the start of the lateral movement mode is not limited to this, and may correspond to a direction in which the bow approaches the direction corresponding to the instruction to laterally move the hull 2. In such a case, for example, in the examples of FIGS. 6A, 10A, and 10B, the position of the acting point F0 of the resultant force FS may be set forward of the center of gravity G. Further, in the example of FIG. 10C, the rotational moment M may be set to a clockwise rotational moment. Moreover, in the example of FIG. 10D, the position of the acting point F0 of the resultant force FS may be set behind the center of gravity G.

FIGS. 11 to 14 are schematic diagrams that show modifications of the thrust acting on the hull 2 in the period between the start of the lateral movement mode and the lateral thrust generation mode (hereinafter, referred to as "in the middle of the mode"). In all of FIGS. 11 to 14, it is assumed that the instruction to laterally move rightward is received. It is assumed that a resultant force FS as shown in FIG. 6A acts on the hull 2 at the start of the lateral movement mode and a resultant force FS as shown in FIG. 6D acts on the hull 2 in the lateral thrust generation mode. That is, FIGS. 11 to 14 correspond to modifications of the resultant force FS in the situation of FIG. 6B and the resultant force FS in the situation of FIG. 6C.

As described below with reference to FIGS. 11 to 14, the controller 40 may change the direction or the acting position of the thrust applied to the hull 2 after generating the thrust to pivot-turn the hull 2 and before applying the thrust in the lateral direction to the hull 2. As a result, it is possible to adjust the attitude of the hull 2 in the middle of the mode.

Figure 11:
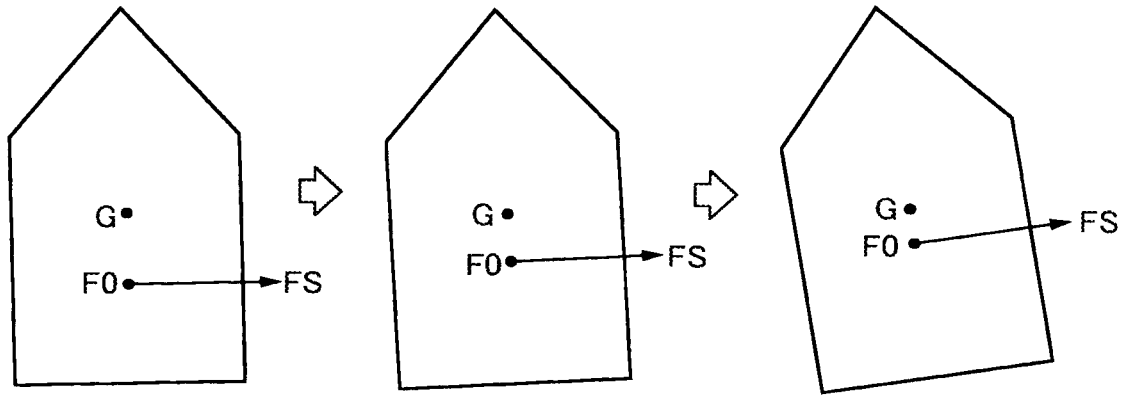
FIG. 11 is a schematic diagram that shows a modification of a thrust acting on the hull in a period between the start of the lateral movement mode and a lateral thrust generation mode.

First, as shown in FIG. 11, the controller 40 may gradually bring the position of the acting point F0 of the resultant force FS closer to the center of gravity G in the middle of the mode. As a result, the pivot-turning speed of the hull 2 gradually decreases, and as a result, the pivot-turning radius gradually increases.

Figure 12:
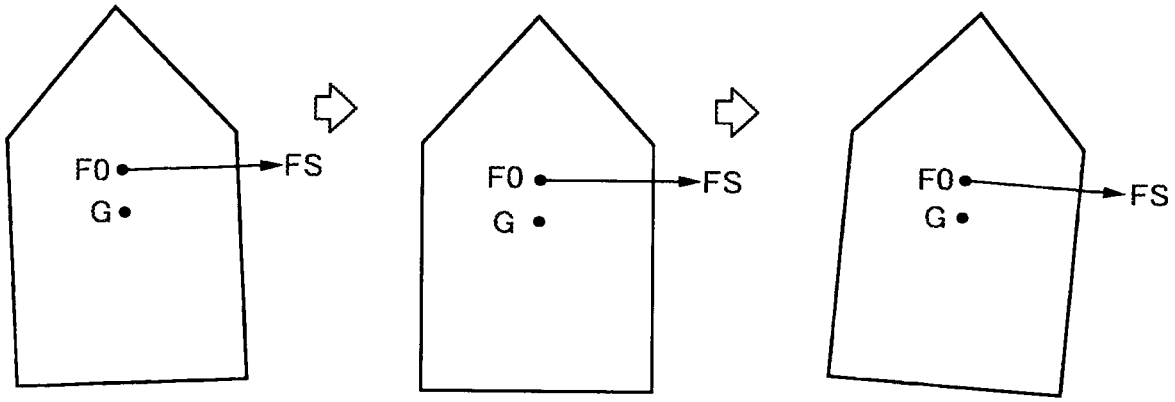
FIG. 12 is a schematic diagram that shows a modification of the thrust acting on the hull in the period between the start of the lateral movement mode and the lateral thrust generation mode.

As shown in FIG. 12, the controller 40 may reverse the position of the acting point F0 in the front-rear direction with respect to the center of gravity G only in the middle of the mode. Alternatively, as shown in FIG. 13, the controller 40 may switch the position of the acting point F0 in the front-rear direction with respect to the center of gravity G (back and forth) a plurality of times in the middle of the mode.

Figure 13:
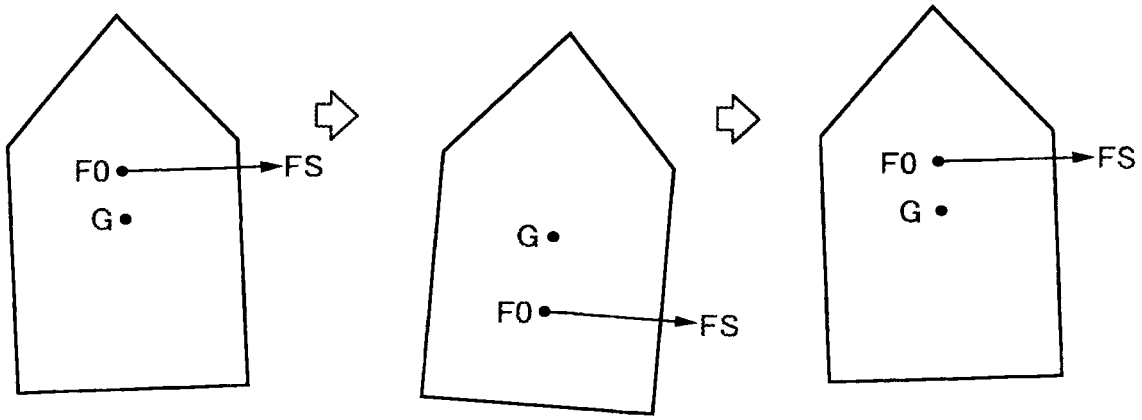
FIG. 13 is a schematic diagram that shows a modification of the thrust acting on the hull in the period between the start of the lateral movement mode and the lateral thrust generation mode.

In the examples of FIGS. 12 and 13, the controller 40 also reverses the pivot-turning direction of the hull 2 while applying a thrust including a lateral component to the hull 2 after generating the thrust to pivot-turn the hull 2 and before applying the thrust in the lateral direction to the hull 2. By reversing the pivot-turning direction of the hull 2 in the middle of the mode, it is easy to enter a come-alongside state when docking.

Figure 14:
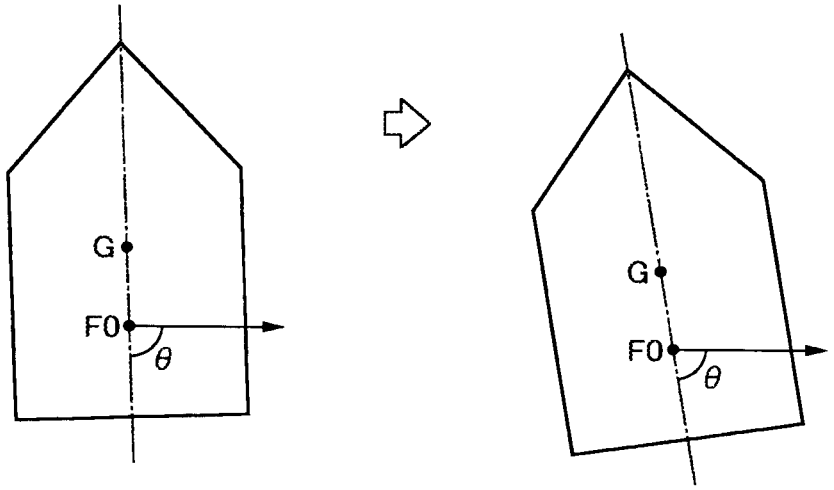
FIG. 14 is a schematic diagram that shows a modification of the thrust acting on the hull in the period between the start of the lateral movement mode and the lateral thrust generation mode.

As shown in FIG. 14, the controller 40 may change the vector direction of the resultant force FS in the middle of the mode. In this example, the angle θ gradually decreases in the middle of the mode. Even when the hull 2 pivot-turns, it is possible to expect to hasten arrival at the target position by giving the resultant force FS a large component toward the target position such as the shore 19 with respect to the hull 2.

It should be noted that the examples of FIGS. 11 to 14 are also useful in the case that the resultant force FS at the start of the lateral movement mode is the resultant force FS shown in any one of FIGS. 10A to 10D.

In addition, the manner in which the resultant force FS is changed in the middle of the mode is not limited to gradually changing the acting position of the resultant force FS, the direction of the resultant force FS, and the magnitude of the resultant force FS, and may stepwisely change at least one of the acting position of the resultant force FS, the direction of the resultant force FS, or the magnitude of the resultant force FS.

In addition, it is assumed that the start of the lateral movement mode is instructed when the hull 2 docks in a stopped state, but the start of the lateral movement mode is not limited to this. The lateral movement mode may be executed during navigating or when laterally moving to another target position instead of docking.

In addition to the left lateral movement switch 53 and the right lateral movement switch 54, an operation element dedicated to the pressing mode that presses the hull 2 sideways may be provided as the another switch 55. In this case, the lateral movement mode may be executed when the operation element dedicated to the pressing mode is operated. It should be noted that the acting position of the resultant force FS, the direction of the resultant force FS, and the magnitude of the resultant force FS may be different between the lateral movement mode executed when the left lateral movement switch 53 or the right lateral movement switch 54 is operated and the lateral movement mode executed when the operation element dedicated to the pressing mode is operated.

Although the present invention has been described in detail based on the preferred embodiments described above, the present invention is not limited to these specific preferred embodiments, and various preferred embodiments within the scope not deviating from the gist of the present invention are also included in the present invention.

For example, the hull 2 may be provided with three or more marine vessel propulsion devices, and the controller 40 may control the three or more marine vessel propulsion devices to realize the control of the lateral movement, the diagonal movement, and the pivot turning. It should be noted that some or all of the marine vessel propulsion devices may be electric motors.

Figure 15:
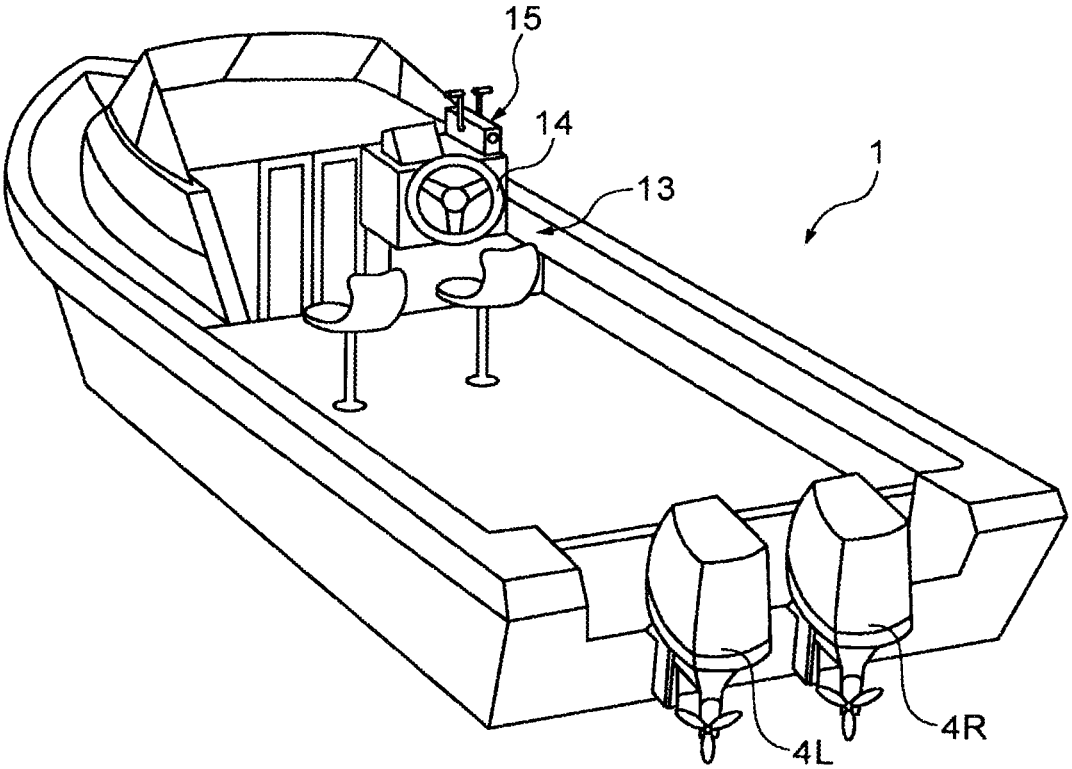
FIG. 15 is a perspective view of another marine vessel.

A marine vessel, to which the present invention is applied, is not limited to a jet propulsion boat, and may be one of other types of marine vessels. For example, as shown in FIG. 15, the marine vessel, to which the present invention is applied, may be a marine vessel that includes outboard motors functioning as the marine vessel propulsion devices 4L and 4R. That is, the marine vessel propulsion devices 4L and 4R are not limited to jet propulsion devices, and may be other marine vessel propulsion devices such as outboard motors.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. A marine vessel maneuvering support apparatus comprising:

a controller configured or programmed to execute a lateral movement mode, in which a lateral thrust is applied to a hull, by controlling at least two propulsion devices in response to receiving an instruction to laterally move the hull; wherein the controller is configured or programmed to control the propulsion devices so as to generate a thrust to pivot-turn the hull at least at a start of the lateral movement mode and then apply the lateral thrust to the hull after generating the thrust to pivot-turn the hull.

2. The marine vessel maneuvering support apparatus according to claim 1, wherein the controller is configured or programmed to apply the lateral thrust to the hull in response to establishment of a predetermined condition after generating the thrust to pivot-turn the hull.

3. The marine vessel maneuvering support apparatus according to claim 2, wherein the controller is configured or programmed to determine whether or not the predetermined condition has been satisfied based on at least one of an elapsed time since the start of the lateral movement mode, a change in a direction of the hull from the start of the lateral movement mode, a speed of the hull, a distance from the hull to a movement target position, a change in a position of the hull from the start of the lateral movement mode, or an input from a marine vessel user.

4. The marine vessel maneuvering support apparatus according to claim 2, wherein, when a predetermined period of time has elapsed since the start of the lateral movement mode, the controller is configured or programmed to determine that the predetermined condition has been satisfied.

5. The marine vessel maneuvering support apparatus according to claim 1, wherein the controller is configured or programmed to change at least one of a direction of a thrust applied to the hull, a magnitude of the thrust applied to the hull, or an acting position of the thrust applied to the hull after generating the thrust to pivot-turn the hull and before applying the lateral thrust to the hull.

6. The marine vessel maneuvering support apparatus according to claim 1, wherein the controller is configured or programmed to reverse a pivot-turning direction of the hull after generating the thrust to pivot-turn the hull and before applying the lateral thrust to the hull.

7. The marine vessel maneuvering support apparatus according to claim 1, wherein the controller is configured or programmed to reverse a pivot-turning direction of the hull while applying a thrust including a lateral component to the hull after generating the thrust to pivot-turn the hull and before applying the lateral thrust to the hull.

8. The marine vessel maneuvering support apparatus according to claim 1, wherein a pivot-turning direction of the hull at the start of the lateral movement mode corresponds to a direction in which a stern of the hull approaches a direction corresponding to the instruction to laterally move the hull.

9. The marine vessel maneuvering support apparatus according to claim 1, wherein a vector direction of the thrust to pivot-turn the hull at the start of the lateral movement mode is a direction corresponding to the instruction to laterally move the hull.

10. The marine vessel maneuvering support apparatus according to claim 1, wherein, after generating the thrust to pivot-turn the hull, and when accepting a steering operation, the controller is configured or programmed to correct a pivot-turning speed of the hull in response to the steering operation.

11. The marine vessel maneuvering support apparatus according to claim 1, wherein the pivot-turn of the hull at the start of the lateral movement mode also includes rotation about a center of gravity of the hull.

12. The marine vessel maneuvering support apparatus according to claim 11, wherein the center of gravity is a resistance center of gravity of the hull.

13. The marine vessel maneuvering support apparatus according to claim 1, wherein the controller is configured or programmed to perform a control to shift an intersection point of a vector of a thrust applied to the hull and a central line extending through a center of gravity of the hull and parallel to a front-rear direction from the center of gravity when viewed from a vertical direction at the start of the lateral movement mode and then bring the intersection point closer to the center of gravity.

14. The marine vessel maneuvering support apparatus according to claim 13, wherein, after shifting the intersection point from the center of gravity when viewed from the vertical direction, the controller is configured or programmed to cause the intersection point coincide with the center of gravity and cause a direction of the vector become a lateral direction corresponding to the instruction to laterally move the hull.

15. The marine vessel maneuvering support apparatus according to claim 1, wherein the controller is configured or programmed to perform a control so that a pivot-turning speed of the hull decreases after generating the thrust to pivot-turn the hull.

16. A marine vessel comprising: the marine vessel maneuvering support apparatus according to claim 1; and the at least two propulsion devices.

* * * * *